United States Patent [19]

Manke

[11] Patent Number: 4,665,991

[45] Date of Patent: May 19, 1987

[54] DOWNHOLE TOOL WITH GAS ENERGIZED COMPRESSIBLE LIQUID SPRING

[75] Inventor: Kevin R. Manke, Marlow, Okla.

[73] Assignee: Halliburton Company, Duncan, Okla.

[21] Appl. No.: 823,543

[22] Filed: Jan. 28, 1986

[51] Int. Cl.[4] ..... E21B 34/10

[52] U.S. Cl. ..... 166/373; 166/321

[58] Field of Search ..... 166/373–375, 166/386, 319, 321, 324

[56] References Cited

U.S. PATENT DOCUMENTS

| | | | |
|---|---|---|---|
| 3,664,415 | 5/1972 | Wray et al. | 166/162 |
| 3,856,085 | 12/1974 | Holden et al. | 166/264 |
| 3,915,228 | 10/1975 | Giebeler | 166/321 |
| 4,076,077 | 2/1978 | Nix et al. | 166/374 |
| 4,109,724 | 8/1978 | Barrington | 166/374 |
| 4,109,725 | 8/1978 | Williamson et al. | 166/374 |
| 4,341,266 | 7/1982 | Craig | 166/317 |
| 4,422,506 | 12/1983 | Beck | 166/324 |
| 4,429,748 | 2/1984 | Beck | 166/324 |
| 4,444,268 | 4/1984 | Barrington | 166/373 |
| 4,448,254 | 5/1984 | Barrington | 166/373 |
| 4,467,867 | 8/1984 | Baker | 166/332 X |
| 4,489,786 | 12/1984 | Beck | 166/374 |
| 4,515,219 | 5/1985 | Beck | 166/374 |
| 4,537,258 | 8/1985 | Beck | 166/374 |
| 4,595,060 | 6/1986 | Beck | 166/373 |

OTHER PUBLICATIONS

Exhibit A—A drawing entitled "APR-N Tete Valve with Double-Volume Chamber".

*Primary Examiner*—Stephen J. Novosad

*Assistant Examiner*—Thuy M. Bui

*Attorney, Agent, or Firm*—James R. Duzan; L. Wayne Beavers

[57] ABSTRACT

An annulus pressure responsive downhole tool includes a housing having a power piston slidably disposed therein. First and second pressure conducting passages communicate a well annulus exterior of the housing with first and second sides of the power piston. A metering cartridge is disposed in the second pressure conducting passage for delaying communication of relatively rapid changes in well annulus pressure to a second side of the power piston to thereby operate the power piston, and for communicating relatively slow changes in well annulus pressure to the second side of the power piston so that hydrostatic well annulus pressure is substantially balanced across the power piston as the apparatus is run into a well. A gas energized compressible liquid spring is contained in a first portion of the second pressure conducting passage between the second side of the power piston and the metering cartridge. The gas energized compressible liquid spring includes a first volume of pressurized compressible gas and a second volume of pressurized compressible liquid, said first and second volumes being such that a substantial portion of a displacement of the power piston is accommodated by changes in each of the first and second volumes.

20 Claims, 8 Drawing Figures

DOWNHOLE TOOL WITH GAS ENERGIZED COMPRESSIBLE LIQUID SPRING

BACKGROUND OF THE INVENTION

1. Field of the Invention

The present invention relates generally to annulus pressure responsive downhole tools utilizing a compressible liquid spring.

2. Description of the Prior Art

The prior art includes a number of downhole tools, such as flow tester valves and circulating valves, which are designed to operate in response to changes in pressure in a well annulus between a tool string and a well casing. Typically, these tools include a differential area piston, which may generally be referred to as a power piston, having one side communicated with well annulus pressure and having another side communicated with a compressible fluid spring chamber.

The compressible fluid spring chamber typically has been filled either with a compressible gas such as nitrogen or a compressible liquid such as silicone oil.

When well annulus pressure is increased to move the power piston of the tool, the fluid in the spring chamber is compressed. Upon decreasing the well annulus pressure, the compressed fluid in the spring chamber expands to aid in returning the power piston to its original position.

Typical examples of prior art tools utilizing compressible nitrogen spring chambers are seen in U.S. Pat. Nos. 4,422,506; 4,429,748; 4,489,786; and 4,515,219, all to Beck and all assigned to the assignee of the present invention.

These prior art tools utilizing compressible nitrogen gas spring chambers rely substantially entirely upon the compression of the nitrogen gas to accommodate the displacement of the power piston of the tool. Although these nitrogen gas tools may have a volume of oil in fluid pressure communication with the nitrogen gas for the purposes of metering the oil through a metering cartridge to provide a time delay in transmission of changes in well annulus pressure to the nitrogen, this oil does not provide any substantial volume change upon movement of the power piston. This is true even when silicone oil is used in these tools, because the volume of oil subject to compression upon movement of the power piston is insignificant as compared to the very large volume of pressurized nitrogen gas which is provided.

One significant problem with tools relying upon compression of nitrogen gas is that the nitrogen gas must be initially placed in the tool at a relatively high pressure on the order of, for example, 4,000 psi. In typical tools such as those shown in U.S. Pat. No. 4,422,506 to Beck, when utilized at hydrostatic well annulus pressures in a range of 2000 to 8000 psi, the initial nitrogen charge pressure will correspondingly range from 1255 psi to 4476 psi. There are dangers of explosion inherent in the assembly and charging of such tools, as are present in any high pressure vessel. These problems are exacerbated by the fact that sometimes nitrogen supplies are not sufficiently pure and contain excessive amounts of oxygen which may cause detonation when these high initial charge pressures are applied to the tool. Additionally, if such an explosion does occur, the large volume of highly pressurized gas provides a very large volume expansion during the explosion which propels pieces of the disintegrating tool with high energy and thus creates a significant danger.

Two prior art circulating valves utilizing compressible silicone oil spring chambers are shown in U.S. Pat. Nos. 4,109,724 to Barrington and 4,109,725 to Williamson et al., both assigned to the assignee of the present invention.

Two prior art tester valves utilizing silicone spring chambers are shown in U.S. Pat. Nos. 4,444,268 and 4,448,254, both to Barrington and both assigned to the assignee of the present invention.

These prior art tools which utilize compressible silicone oil to accommodate the displacement of the power piston require a very large volume of silicone oil due to the relatively low compressibility of silicone oil. This means that the tool must be relatively large. Even though such tools when assembled may have a relatively small mass of air trapped in the tool which becomes compressed along with the silicone oil, the mass of air present in the tool is insignificant as compared to the mass of oil present in the tool, and thus the trapped air does not significantly contribute to the volume change which must be provided to accommodate the displacement of the power piston of the tool.

SUMMARY OF THE INVENTION

The present invention provides an improved design for a tool utilizing a compressible fluid spring chamber, by providing a gas energized compressible liquid spring chamber which contains a significant amount of compressible gas, such as air or nitrogen, and a significant amount of a compressible liquid such as silicone oil, which can be placed in the tool at an initial charge pressure generally less than that normally required in nitrogen tools while providing a tool of a size less than that generally required for tools which rely solely upon compression of silicone oil.

The lower initial charge pressure substantially eliminates the danger of explosion which is present with nitrogen tools. Additionally, there is a much smaller volume of compressed gas which minimizes the volume expansion in the event of an explosion.

Numerous objects, features and advantages of the present invention will be readily apparent to those skilled in the art upon a reading of the following disclosure when taken in conjunction with the accompanying drawings.

BRIEF DESCRIPTION OF THE DRAWINGS

FIG. 2 has been rotated 90° clockwise to aid in fitting the same on the sheet of drawings.

DETAILED DESCRIPTION OF THE PREFERRED EMBODIMENTS

Figure 1A:
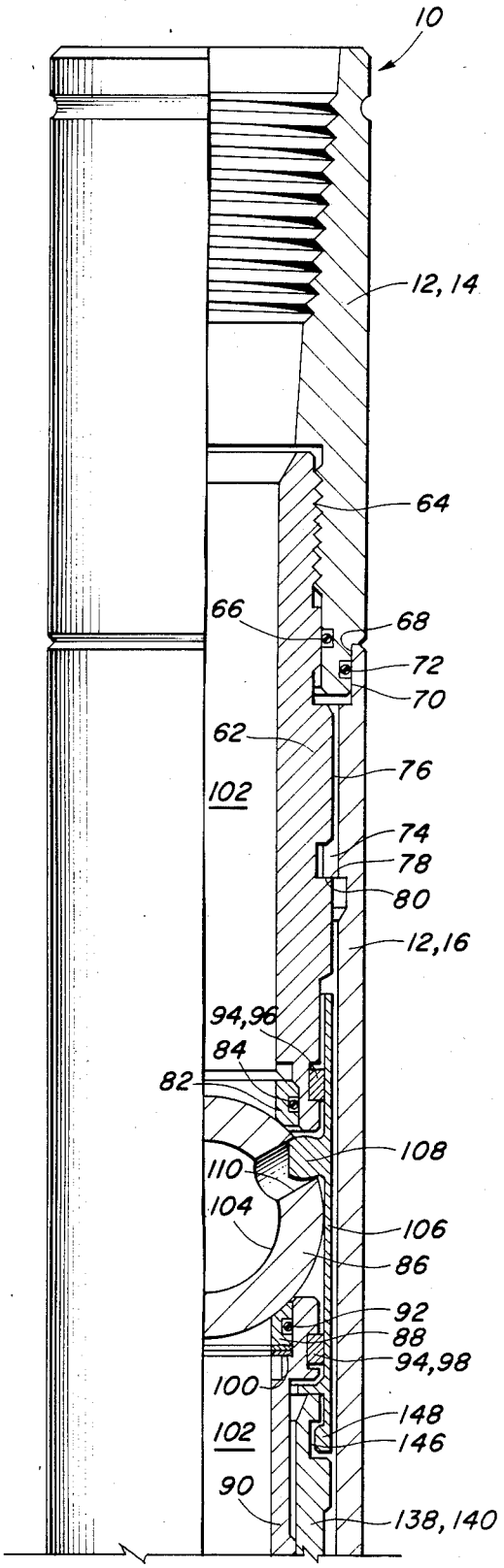
FIGS. 1A–1F comprise an elevation view of a downhole tool embodying the present invention, with the right side of the tool shown in section.

During the course of drilling an oil well, the borehole is filled with a fluid known as drilling fluid or drilling mud. One of the purposes of this drilling fluid is to contain in intersected formations any formation fluid which may be found therein. To contain these formation fluids, the drilling mud is weighted with various additives so that the hydrostatic pressure of the mud at the formation depth is sufficient to maintain the formation fluid within the formation without allowing it to escape into the borehole.

When it is desired to test the production capabilities of the formation, a testing string is lowered into the borehole to the formation depth and the formation fluid is allowed to flow into the string in a controlled testing program. Lower pressure is maintained in the interior of the testing string as it is lowered into the borehole. This is usually done by keeping a valve in the closed position near the lower end of the testing string. When the testing depth is reached, a packer is set to seal the borehole thus closing in the formation from the hydrostatic pressure of the drilling fluid in the well annulus.

The valve at the lower end of the testing string, which is generally referred to as a tester valve, is then opened and the formation fluid, free from the restraining pressure of the drilling fluid, can flow into the interior of the testing string.

The testing string will include a number of tools, many of which may be constructed to be operated in response to changes in pressure within the well annulus.

Two tools which are typically present in a testing string, and which are often constructed to be operated in response to changes in well annulus pressure are those tools commonly referred to as tester valves, and those tools which are commonly referred to as circulating valves.

A detailed description of the general makeup of such a testing string as utilized in an offshore environment, and indicating the location of tester valves and circulating valves in such a string, is shown, for example, in U.S. Pat. No. 4,448,254 to Barrington, with regard to FIG. 1 thereof, the details of which are incorporated herein by reference.

FIGS. 1A–1F of the present application comprise an elevation, right-side sectioned view, of a flow tester valve apparatus 10 of the type which may be used in such a testing string as that just described.

The valve apparatus 10 includes an outer housing 12. The outer housing 12 itself includes an upper housing adapter 14, a valve housing section 16, a shear nipple 18, a power housing section 20, a spring chamber connector nipple 22, an upper spring chamber housing section 24 including concentric inner and outer tubular members 26 and 28, an upper filler nipple 30, a lower spring chamber housing section 32 including concentric inner and outer tubular members 34 and 36, a lower extension mandrel 38 connected to inner tubular member 34, a lower filler nipple 40, an equalizing chamber housing section 42 including inner and outer tubular members 44 and 46, a metering cartridge 48 connecting lower extension mandrel 38 and inner member 44, and a lower adapter 50.

Referring to FIG. 1A, a holder mandrel 62 has its upper end threadedly connected to upper adapter 14 at threaded connection 64 with a seal being provided therebetween by O-ring 66.

The valve housing section 16 has an upper inner cylindrical surface 68 in which is closely received a lower outer cylindrical surface 70 of upper adapter 14 with a seal being provided therebetween by O-ring 72.

The valve housing section 16 includes a plurality of radially inward extending splines 74 which are meshed with a plurality of radially outward extending splines 76 of holder mandrel 62 to prevent relative rotation therebetween.

Holder mandrel 62 includes a radially outwardly extending upward facing ledge 78 which is located below and engages lower ends 80 of the radially inward extending splines 74 so that the valve housing section 16 is held longitudinally fixed relative to the upper housing adapter 14 by means of holder mandrel 62.

An upper annular valve seat 82 is received in a lower inner bore of holder mandrel 62 with a seal being provided therebetween by O-ring 84.

A spherical ball valve member 86 sealingly engages upper seat 82, and also sealingly engages a lower annular seat 88.

Lower seat 88 is received within an upper inner bore of a lower seat holder mandrel 90 with a seal being provided therebetween by O-ring 92.

The lower seat holder mandrel 90 is held in place relative to upper holder mandrel 62 by a C-clamp 94 which has upper and lower ends 96 and 98 which are visible in FIG. 1A.

A pair of Belleville springs 100 bias the lower annular seat 88 against the spherical ball valve member 86.

The tester valve 10 has a longitudinal flow passage 102 disposed therethrough. The ball valve member 86 is shown in FIG. 1A in a closed position closing the flow passage 102.

Ball valve member 86 has a cylindrical ball valve bore 104 disposed therethrough which can be aligned with the flow passage 102 to place the tester valve 10 in an open position.

An actuating arm 106 having an actuating lug 108 disposed thereon engages an eccentric bore 110 disposed through the side of ball valve member 86 so that the ball valve member 86 may be rotated to an open position upon downward movement of actuating arm 106 relative to the housing 12.

Actually, there are two such actuating arms 106 with lugs 108 engaging two eccentric bores 110 in a manner such as that illustrated and described in detail in U.S. Pat. No. 3,856,085 to Holden et al., and assigned to the assignee of the present invention.

A power mandrel means 112 includes a top power mandrel section 114 and a bottom power mandrel section 116 which are threadedly connected together at 118, with a seal 119 being provided therebetween. Formed on the bottom power mandrel section 116 is a power piston 120 which is received within a cylindrical inner bore 122 of power housing section 20. A sliding seal means 124 seals between power piston 120 and bore 122.

Top power mandrel section 114 includes radially outward extending splines 126 which mesh with a plurality of radially inward extnding splines 128 of shear nipple 18 to prevent relative rotation therebetween.

An intermediate portion of top power mandrel section 114 is closely received within a bore 130 of shear nipple 18 and a seal is provided therebetween by seals 132.

A power mandrel cap 134 is threadedly attached at 136 to the upper end of top power mandrel section 114.

A connector assembly 138 includes an upper connector piece 140 and a lower connector piece 142 threadedly connected together at 144.

The upper connector piece 140 includes a groove 146 within which is received a lip 148 of actuating arm 106 so that actuating arm 106 and upper connector piece 140 move together longitudinally within the housing 12.

The power mandrel cap 134 is held between upward and downward facing surfaces 150 and 152 of connector assembly 138 so that upon longitudinal movement of power mandrel means 112, the connector assembly 138 moves longitudinally therewith which also moves the actuating arms 106 longitudinally therewith so as to operate the ball valve 86.

The lower seat holder mandrel 90 has a cylindrical outer surface 154 which is closely received within a bore 156 of upper connector assembly piece 140 with a seal being provided therebetween by O-ring 158.

Lower connector assembly piece 142 has an outer cylindrical surface 160 of top power mandrel section 114 closely received within a bore 162 thereof with a seal being provided therebetween by O-ring 164.

An outer surface 166 of lower connector assembly piece 142 is closely and slidably received within a bore 168 of valve housing section 16 with a sliding seal being provided therebetween by O-ring 170.

A plurality of radially extending ports 172 are disposed through top power mandrel section 114 to prevent hydraulic lockup when the power mandrel means 112 moves the connector assembly 138.

The valve housing section 16 is threadedly connected to shear nipple 18 at 174 with a seal being provided therebetween by O-ring 176.

Disposed in shear nipple 18 are one or more shear pins 178 held in place by shear pin holders 180 which are threaded into the shear nipple 18.

Each of the shear pins 178 are initially partly received within an outer annular groove 182 of top power mandrel section 114 so as to initially pin the power mandrel means 112 in the position illustrated in the figures thus holding the ball valve 86 in a closed position. Upon applying an appropriate differential pressure across the power piston 120, the shear pins 178 will shear thus releasing the power mandrel means 112 and allowing it to move downward to rotate the ball valve 86 to an open position with its bore 104 aligned with the flow passage 102 of the tool 10.

Shear nipple 18 is threadedly connected to power housing section 20 at 184 with a seal being provided therebetween by O-ring 186.

Disposed through the wall of power housing section 20 above the seals 124 of power piston 120 are one or more power ports 188 for communicating an upper first side 190 of power piston 120 with the well annulus exterior of the housing 12. Power piston 122 also includes a lower second side 192.

As will be understood by those skilled in the art, the power piston 120 is actually defined as the annular area between an outside diameter defined by seal 124 engaging the bore 122 and an inside diameter defined by seal 206 engaging an outer surface 202 of bottom power mandrel section 116.

Outer surface 202 of the lower portion of bottom power mandrel section 116 is closely and slidably received within a bore 204 of spring chamber connector nipple 22 with two longitudinally spaced seals 206 and 208 being provided therebetween.

Power housing section 20 is threadedly connected to spring chamber connector nipple 22 at 210 with a seal being provided therebetween by seal 212.

One or more relief holes 214 communicate the well annulus with an inner annular groove 216 of spring chamber connector nipple 22 between the seals 206 and 208 to prevent hydraulic lockup of the power mandrel means 112 as it moves within the spring chamber connector nipple 22.

The lower end of spring chamber connector nipple 22 is threadedly connected to inner member 26 of upper spring chamber housing section 24 at threaded connection 218 with a seal being provided therebetween at 220.

Outer concentric member 28 of upper spring chamber housing section 24 is threadedly connected at 222 to the lower end of spring chamber connector nipple 22 with a seal being provided therebetween by seal means 224.

A plurality of longitudinally extending ports 226 are disposed through spring chamber connector nipple 22.

An outer cylindrical surface 228 of inner concentric member 26 is closely received within a bore 230 of upper filler nipple 30 with a pair of seals being provided therebetween by seals 232 and 234.

A plurality of relief holes 236 communicate an inner annular groove 238 of upper filler nipple 30 with the well annulus.

The outer tubular member 28 of upper spring chamber housing section 24 is threadedly connected to upper filler nipple 30 at 237 with a seal being provided therebetween by seals 239.

Inner tubular member 34 of lower spring chamber housing section 32 is threadedly connected to upper filler nipple 30 at 241, with a seal being provided therebetween by O-ring 243.

The lower extension mandrel 38 is threadedly connected to the lower end of inner tubular member 34 at threaded connection 240 with a seal being provided therebetween by O-ring 242.

A lower end of lower extension mandrel 38 is closely received within a bore 244 of metering cartridge 48 with a seal being provided therebetween by O-ring 246.

Outer tubular member 36 is threadedly connected to lower filler nipple 40 at threaded connection 248 with a seal being provided therebetween by O-ring 250. The lower end of lower filler nipple 40 is threadedly connected to outer member 46 of equalizing chamber housing section 42 at threaded connection 252 with a seal being provided therebetween by O-ring 254.

An irregular annular space 256 is radially defined between lower extension mandrel 38 on the inside and outer tubular member 36 and lower filler nipple 40 on the outside.

The inner member 44 of equalizing chamber housing section 42 of housing 12 is connected to metering cartridge 48 at threaded connection 258 with a seal being provided therebetween O-ring 260.

An O-ring 262 seals between an outer surface 264 of metering cartridge 48 and an inner bore 266 of outer tubular member 46.

Outer tubular member 46 has first and second oil fill ports 268 and 270 disposed therethrough which are blocked by plugs 272 and 274, respectively.

The lower filler nipple 40 has an oil fill port 271 disposed therethrough which is blocked by a plug 273.

An equalizing chamber 276 is defined between inner and outer tubular members 44 and 46 of equalizing chamber housing section 42.

The metering cartridge 48 has a pressurizing passage 296 and a depressurizing passage 298 disposed longitudinally therethrough, each of which communicate the irregular annular space 256 with equalizing chamber 276.

A floating piston 278 is received in the lower end of equalizing chamber 276.

Piston 278 includes radially inner and outer upper seals 280 and 282, respectively, and radially inner and outer lower seals 284 and 286, respectively.

An equalizing port 288 is disposed through outer tubular member 46 to communicate the lower end of equalizing chamber 276 blow piston 278 with a well annulus exterior of the housing 12.

The inner tubular member 44 has an outer cylindrical surface 290 thereof closely received within a bore 292 of lower adapter 50 with a seal being provided therebetween by O-ring 294.

The power port 188 and an annular space 300 defined between power piston 120 and power housing section 20 above seal 124 can generally be referred to as a first pressure conducting passage means 302 for communicating the well annulus exterior of the housing 12 with the upper first side 190 of power piston 120.

A second pressure conducting passage means 304 is disposed in the housing 12 and communicates the lower second side 192 of power piston 120 with the well annulus exterior of the housing 12.

The second pressure conducting passage means 304 includes, from top to bottom, an annular first spring chamber portion 306 defined between bottom power mandrel section 116 and power housing section 20, the longitudinal ports 226 disposed through spring chamber connector nipple 22, an annular second spring chamber portion 308 defined between inner and outer members 26 and 28 of upper spring chamber housing section 24, a plurality of longitudinal ports 310 disposed through upper filler nipple 30, an annular third spring chamber portion 312 defined between inner and outer tubular members 34 and 36 of lower spring chamber housing section 32, the irregular annular space 256, the pressurizing and depressurizing passages 296 and 298 disposed through metering cartridge 48, equalizing chamber 276, and equalizing port 288.

It is possible to include a mechanical return spring in the annular first spring chamber portion 306 between power piston 120 and the upper end of spring chamber connector nipple 22, similar to the spring 408 shown in FIG. 2*c* of U.S. Pat. No. 4,429,748 to Beck.

The metering cartridge 48 can generally be described as dividing the second pressure conducting passage means 304 into a first portion 356 between the second side 192 of power piston 120 and metering cartridge 48, and a second portion 358 between metering cartridge 48 and the well annulus exterior of the housing 12.

Devices located in pressurizing passage 296 and depressurizing passage 298 control the flow of oil between equalizing chamber 276 and the irregular annular space 256 as will be further described in detail below.

Other types of retarding means other than the metering cartridge 48 might be utilized, such as the floating shoe retarding means described in U.S. Pat. No. 4,515,219 to Beck.

The pressurizing passage 296 has disposed therein an upper filter 314, a pressure relief or check valve 316, a flow restrictor 318, and a lower filter 320. Upper and lower screens 322 and 324, respectively, cover the ends of pressurizing passage 296.

The flow restrictor 318 comprises a small orifice jet which impedes the flow of fluid from equalizing chamber 276 to the irregular annular space 256 so as to provide a time delay in the transmission of increases in well annulus pressure to the lower side 192 of power piston 120.

Item 316 will usually be a pressure relief valve means which allows flow in an upward direction therethrough when the pressure in equalizing chamber 276 exceeds the pressure in irregular annular space 256 by a predetermined value, for example, 400 psi. Pressure relief valve 316 does not permit flow in a downward direction through the pressurizing passage 296. In some instances, a simple one-way check valve may be substituted for the pressure relief valve 316.

The depressurizing passage 298 includes upper filter 326, a flow restrictor 328, a check valve 330 and a lower filter 332. The upper and lower ends of depressurizing passage 298 are covered by upper and lower screens 334 and 336.

The check valve 330 allows downward flow therethrough but prevents upward flow therethrough. In some instances, the check valve 330 may be replaced with a pressure relief valve like pressure relief valve 316.

Flow restrictor 328 impedes the flow of fluid downward through the depressurizing passage 298 and provides a time delay in transmission of decreases in well annulus pressure from the well annulus to the lower side 192 of power piston 120.

The operation of the pressure relief valve 316 and check valve 330 will be better understood from the following example. After the tester valve 10 has been set at the desired location within a well, an operating pressure increase of, for example, 2,000 psi will be imposed upon the well annulus so that the pressure exterior of the housing 12 exceeds hydrostatic pressure by 2,000 psi.

The 400 psi pressure relief valve 316 will only allow 1,600 psi of this pressure increase to be felt on the lower side 192 of power piston 120. Of course, there will be a significant time delay on the order of two minutes or more, for the entire 1,600 psi pressure increase to be felt on the lower side of power piston 192 as a result of the fluid flow restrictor 318. The purpose of the 400 psi pressure relief feature of valve 316 is to insure that the ball valve 86 is held open so long as the increased well annulus pressure is maintained.

Subsequently, when well annulus pressure is dropped back to hydrostatic pressure, the check valve 330 will allow the pressure between the power piston 120 and the metering cartridge 48 to drop back to substantially hydrostatic pressure. The flow restrictor 328 will provide approximately a two-minute delay in this pressure drop. It is noted that the check valve 330 will in fact have a relatively small permanent pressure drop thereacross, of perhaps 15 psi, due to the need for a biasing spring to insure that the check valve seats. Thus, the pressure between piston 120 and metering cartridge 48 will drop back to a pressure slightly (e.g., perhaps 15 psi) greater than hydrostatic well annulus pressure.

The metering cartridge 48, and particularly the fluid flow restrictor 318 in the pressurizing passage 296 thereof, can generally be referred to as a retarding means 48,318 disposed in the second pressure conducting passage means 304 for delaying communication of a sufficient portion of a relatively rapid increase in well annulus pressure to the lower second side 192 of power piston 120 for a sufficient time to allow a pressure differential from the upper first side 190 to the lower second side 192 of power piston 120 to move the power piston 120 downward relative to the housing 12 in response to the relatively rapid increase in well annulus pressure.

The power piston 120 is reciprocated within the housing 12 in response to changes in well annulus pressure in the following general manner.

A relatively rapid increase in well annulus pressure will be immediately transferred to the upper side 190 of power piston 120, but will be delayed in being communicated with the lower side 192 of power piston 120, so that a rapid increase in well annulus pressure will create a downward pressure differential across the power piston 120 thus urging it downwardly within the housing 12.

Similarly, a relatively rapid decrease in well annulus pressure will create an upward pressure differential across power piston 120 moving the power piston 120 upward relative to the housing 12.

This reciprocating motion of the power piston 120 is transmitted to the ball valve 86 by the power mandrel means 112, connector assembly 138, and actuating arms 106.

Figure 1B:
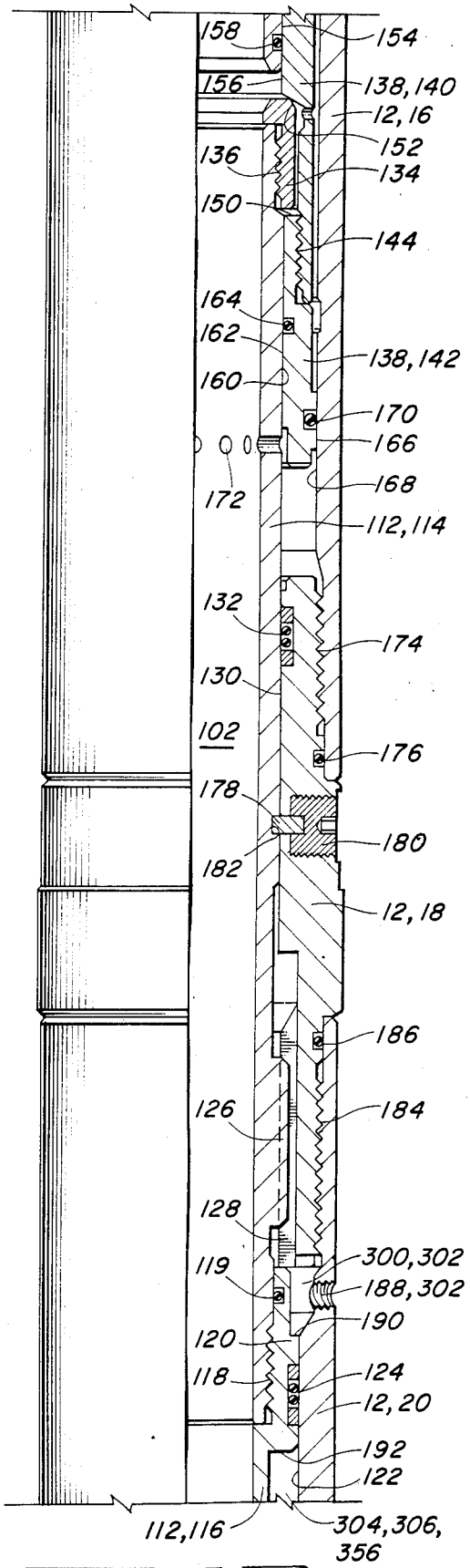

When the power piston 120 is in its upper position as shown in FIG. 1B, the ball valve 86 is in its closed position as shown in FIG. 1A. When the power piston 120 moves downward to a lower second position in response to a relatively rapid increase in well annulus pressure, the actuating mandrel means 112 and connector means 138 pull the actuating arms 106 downward so that the ball valve 86 is rotated by the actuating lugs 108 to an open position wherein its bore 104 is aligned with the flow passage 102 disposed through the tester valve 10.

Figure 1C:
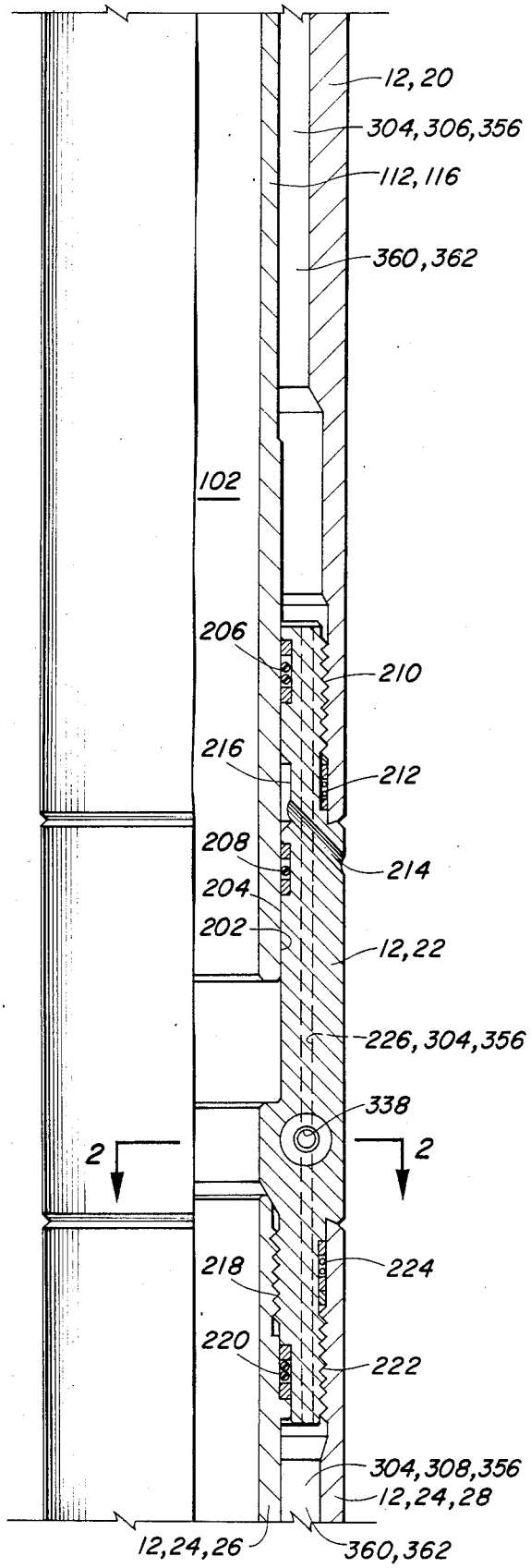
Figure 2:
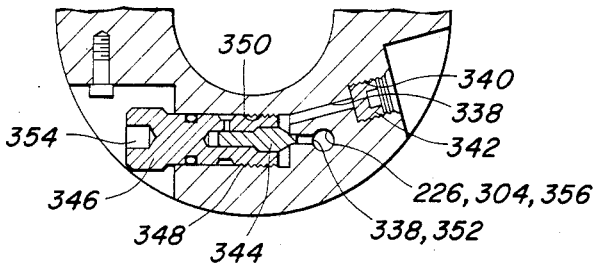
FIG. 2 is a sectional view taken along line 2—2 of FIG. 1C which shows an injection valve means.

As seen in FIG. 1C and FIG. 2, a fluid injection passage 338 is disposed through spring chamber connector nipple 22 of housing 12 and intersects the longitudinal ports 226.

Air injection passage 338 includes a threaded inlet 340, which is shown in FIG. 2 as being temporarily closed by a threaded plug 342.

A needle valve 344 is disposed in a valve carrier body 346 which itself is threadedly engaged at 348 with a threaded bore 350 of spring chamber connector nipple 22.

In FIG. 2, the needle valve 344 is shown in a closed position where it sealingly engages a short portion 352 of fluid injection passage 338.

To open the fluid injection passage 338 in order to inject fluids therethrough into the second fluid conducting passage means 304, as is further described below, the plug 342 is removed and an injection line (not shown) is connected to threaded bore 340. Then the valve carrier body 346 is rotated through use of a wrench inserted in a socket 354 thereof so as to back off the threaded connection 348 and move needle valve 344 out of engagement with the short portion 352 of fluid injection passage 338.

A similar injection valve may be located in upper filler nipple 30.

A gas energized compressible liquid spring means 360 is contained in the first portion 356 of second pressure conducting passage means 304 for returning the power piston 120 to its upper first position as seen in FIG. 1B in response to a relatively rapid decrease in well annulus pressure.

Figure 1D:
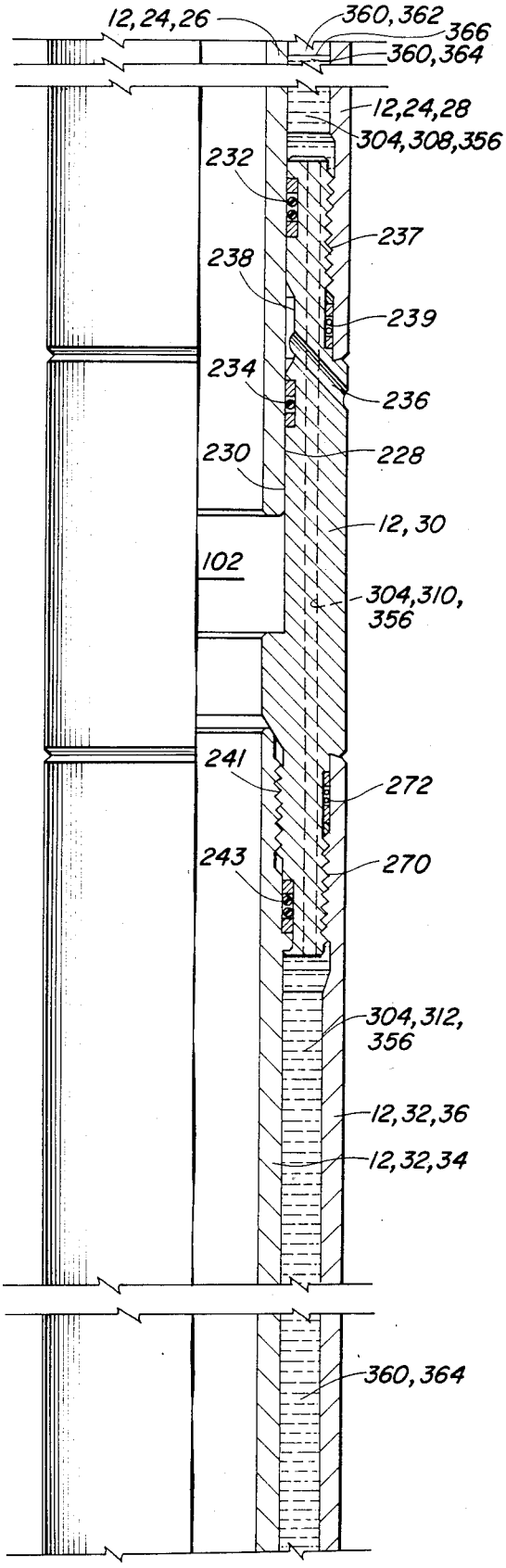

The gas energized compressible liquid spring means 360 includes a first volume 362 of pressurized compressible gas and a second volume 364 of pressurized compressible liquid, which meet at a gas-liquid interface 366 all as schematically illustrated near the top of FIG. 1D.

Figure 1E:
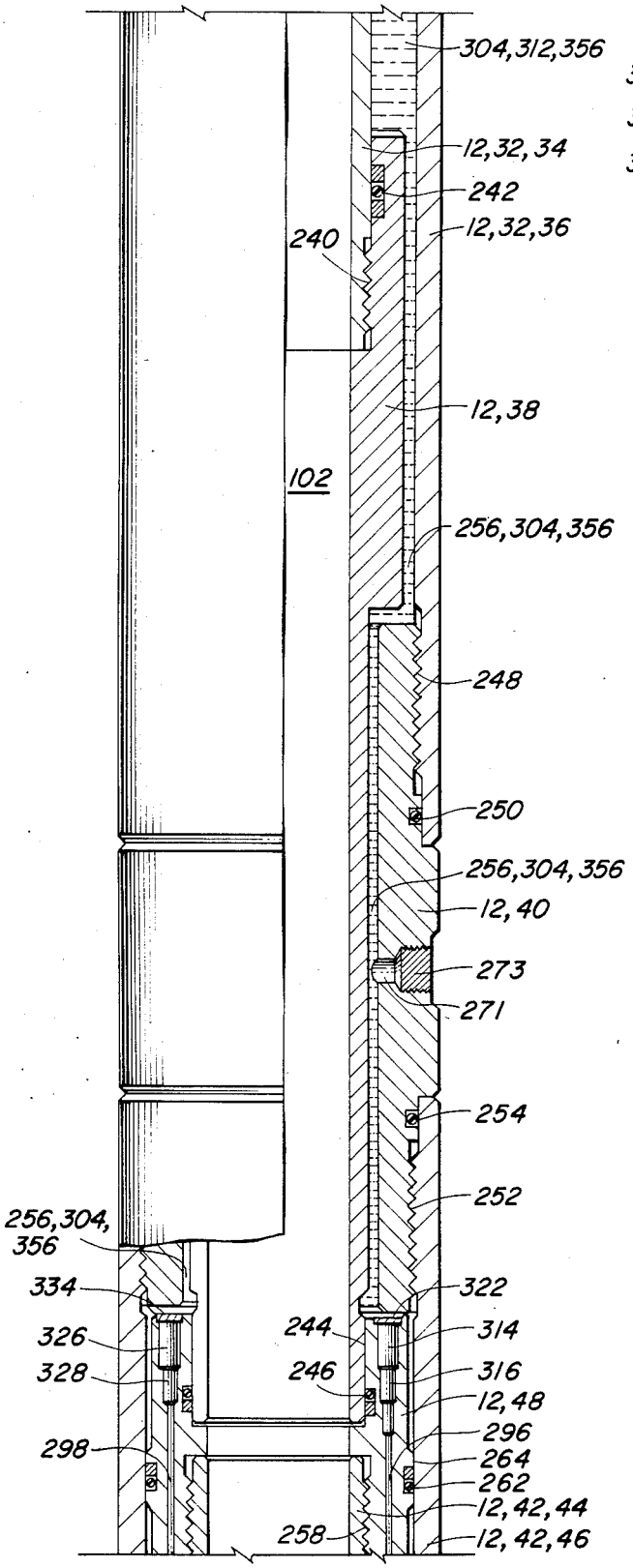

The compressible liquid 364 below interface 366 is schematically shown in FIGS. 1D and 1E by horizontal shading.

It will be appreciated that the gas-liquid interface 366 will vary in elevation relative to the housing 12 during the use of the tester valve 10.

The successful use of the present invention is dependent upon having appropriate volumes 362 and 364 of the compressible gas and compressible liquid, respectively, within the first portion 356 of second pressure conducting passage means 304. Generally, the first and second volumes 362 and 364 can be described as being such that a substantial portion of a displacement of the power piston 120 as it moves between its upper first position illustrated in FIG. 1B wherein the ball valve 86 is closed, and a lower second position relative to housing 12 wherein the ball valve 86 is open, is accommodated by changes in each of the first and second volumes 362 and 364. That is, volume 362 changes by an amount which is a substantial portion of the displacement of piston 120, and volume 364 also changes by an amount which is a substantial portion of the displacement of power piston 120 when the power piston 120 moves between its first and second positions relative to housing 12.

The appropriate volumes 362 and 364 of compressible gas and compressible liquid, respectively, are placed in the first portion 356 of second pressure conducting passage means 304 in the following manner.

An injection line (not shown) is connected to threaded bore 340 leading to the injection valve 344 shown in FIG. 2.

The injection valve 344 is opened to place the injection line in communication with the longitudinal ports 226 of spring chamber connector nipple 22.

Then, a compressible gas at an initial pressure in a range from about 100 psi to about 500 psi is injected into the longitudinal ports 226. This compressible gas will fill at least the first portion 356 of second pressure conducting passage means 304, and depending upon the construction of the check valve 330 in depressurizing passage 298 of metering cartridge 48, the second portion 358 of second pressure conducting passage means will also be filled with compressible gas at a pressure near that of the compressible gas in the first portion 356 of second pressure conducting passage means 304. As previously mentioned, the check valve 330 will generally have a slight pressure drop thereacross on the order of 15 psi, and thus the initial pressure of gas injected into the second portion 358 of second pressure conducting passage means 304 will be slightly less than the pressure of the gas injected into first portion 356.

Preferably, the compressible gas injected into the second pressure conducting passage means 304 is compressed air supplied from a rig air system of a drilling rig. The rig air system of a drilling rig will typically provide a maximum air pressure in a range from about 100 psi to about 140 psi.

Alternatively, the compressible gas may be compressed nitrogen provided from a high pressure nitrogen bottle or the like. This will generally be used only if a rig air system providing at least 100 psi is not available. As will be apparent from the examples given below, however, there may be situations in which additional initial pressure is needed for the compressible gas, and in those instances compressed nitrogen gas or some other inert gas from a high pressure bottle or other supply may be utilized rather than utilizing rig air pressure.

Rig air will preferably be used where the particular operating conditions for the tester valve 10 are such that the tester valve 10 will be operable, because that eliminates the need for auxiliary equipment such as compressed nitrogen supplies and the like. If a greater initial gas injection pressure is necessary than that which can be provided by the available rig air system, or if in an unusual situation a rig air system is not available, alternative supplies such as a bottle of pressurized nitrogen gas or the like may be utilized.

After the compressible gas has been injected into the second pressure conducting passage means 304, a compressible liquid, preferably silicone oil, is injected past the same injection valve 344. This compressible silicone oil is injected into the second pressure conducting passage means 304 until the pressure contained in the second pressure conducting passage means 304 reaches a desired initial charge pressure. This initial charge pressure will be substantially in excess of 500 psi, and typically will be on the order of 1,000 to 2,000 psi.

The volume 364 of compressible liquid injected in this manner into the second pressure conducting passage means 304 will, when the apparatus 10 is oriented in a vertical fashion, fill the equalizing chamber 276 between metering cartridge 48 and floating piston 278, and will also fill a substantial part of the first portion 356 of second pressure conducting passage means 304.

It is noted that during the injection of compressible gas and compressible liquid into the apparatus 10 in the manner just described, the apparatus 10 may be oriented either horizontally or vertically.

After the compressible gas 362 and compressible liquid 364 have been placed in the second pressure conducting passage means 304, the injection valve 344 is closed and the apparatus 10 is ready to be placed in a well. The tester valve 10 is connected to a tubing string (not shown) like that shown in U.S. Pat. No. 4,448,254 to Barrington, previously incorporated herein by reference, and the tool is lowered on the tubing string to a desired elevation within a well.

As the tester valve 10 is lowered into the well, hydrostatic well annulus pressure will steadily and relatively slowly increase, and this increasing hydrostatic well annulus pressure will be transmitted through the pressurizing passge 296 to the lower side 192 of power piston 120 to substantially balance hydrostatic well annulus pressure across the power piston 120.

The increase in hydrostatic well annulus pressure is transferred from equalizing chamber 276 to the first portion 356 of second pressure conducting passage means 304 by the flow of silicone oil upward from equalizing chamber 276 through pressurizing passage 296 into the first portion 356 of second pressure conducting passage means 304.

The pressure in first portion 356 of second pressure conducting passage means 304 will continually increase and be substantially equal to hydrostatic well annulus pressure within the well at the elevation at which the tool 10 is located at any given moment in time. There will be a time delay in transmitting the increased pressure through the pressurizing passage 296 due to the effect of the flow restrictor 318, but the rate at which the apparatus 10 is being lowered and the corresponding rate of increase of hydrostatic well annulus pressure will be sufficiently low that the downward pressure differential across power piston 120 will never be sufficient to shear the shear pins 178 as the tester valve 10 is being lowered into the well.

After the tester valve 10 has been lowered to the desired elevation within a well, a packer (not shown) located therebelow in the test string will be set to seal the well annulus below the tester valve 10.

Then, well annulus pressure will be increased relatively rapidly to the design operating pressure of the tester valve 10 to create a downward pressure differential across power piston 120 sufficient to shear the shear pins 178 and to move the power piston 120 downward relative to the housing 12 so as to rotate the ball valve 86 to an open position.

As the power piston 120 moves downward, it displaces a volume of first portion 356 of second pressure conducting passage means 304 equal to the displacement of the power piston 120.

The displacement of power piston 120 is equal to its differential annular area as defined between seals 124 and 206 multiplied times the vertical distance the power piston 120 moves between its upper position shown in FIG. 1B and its lowermost position corresponding to the open position of ball valve 86.

This displacement of power piston 120 must be accommodated by a compression of the gas energized compressible liquid spring means 360 contained in first portion 356 of second pressure conducting passage means 304.

A substantial portion of the displacement of power piston 120 is accommodated by a decrease in volume of each of the compressible gas 362 and the compressible liquid 364.

Manner Of Modifying An Original Tool Utilizing Compressible Gas To Instead Utilize A Gas Energized Compressible Liquid The particular construction of the tester valve 10 shown in FIGS. 1A–1F, utilizing a gas energized compressible silicone oil spring chamber, is one which can be made by modifying a typical prior art compressible gas operated tester valve of the type presently utilized by the assignee of the present invention.

A typical construction for such a prior art tester valve constructed originally to operate with a compressed gas spring chamber is shown in U.S. Pat. No. 4,429,748 to Beck and assigned to the assignee of the present invention. Specifically, FIGS. 2A–2G of the Beck '748 patent disclose such a structure.

As is apparent from a comparison of the apparatus shown in the present disclosure to that shown in FIGS. 2A–2G of the Beck '748 patent, the upper portions of the tool shown in the present application, and particularly those portions shown in FIGS. 1A–1C from the top adapter 12 down through the spring chamber connector nipple 22, are substantially similar to the structure shown in FIGS. 2A–2D of the Beck '748 patent.

The overall differences in the tools are found in the volume of the spring chamber, the displacement of the power piston, the jetting of the metering cartridge, the elimination of the floating piston 210 seen in FIG. **2*e*** of the Beck '748 patent above the metering cartridge, the use of silicone oil, the lower gas pressures, and the volumes of gas and oil contained between the power piston and the metering cartridge.

With regard to the changes in the spring chamber volume, it is necessary to increase the spring chamber volume in order for the tool to operate based upon a gas energized compressible silicone oil spring as compared to a high pressure compressible gas spring.

To modify an apparatus like that shown in the Beck '748 patent, which is originally designed to operate on compressed gas, in order that such apparatus will have a sufficient spring chamber volume to operate on a gas energized compressible silicone oil spring, it is necessary basically to delete those portions of the Beck '748 tool below its spring chamber connector nipple 258 and substitute therefor those portions of the present apparatus below the spring chamber connector nipple 22.

In the present invention, the volume of the first spring chamber portion 306 and the second spring chamber portion 308 combined are approximately equal to the volume of the spring chamber in the original tool of the Beck '748 patent constructed to operate on compressed high pressure nitrogen gas.

The present invention adds the additional spring chamber portion 312 to provide a sufficient volume that the tool may operate on a gas energized compressible liquid spring rather than by compressing high pressure nitrogen gas.

Additionally, the tester valve apparatus of the present invention has been modified as compared to the apparatus of the Beck '748 patent so as to decrease the differential area of the power piston. This has been done to minimize the displacement of the power piston and thus minimize the required volume of the first portion 356 of second pressure conducting passage means 304.

This has been accomplished by providing a modified bottom power mandrel section 116 having a power piston 120 of reduced diameter, and by providing a modified power housing section 20 having a reduced diameter inner cylindrical surface 122.

Additionally, when modifying a tool to operate on the compression of a gas energized silicone oil spring rather than the compression of a high pressure nitrogen gas spring, it will be appreciated that the transfer of a given pressure change to the gas energized silicone oil spring is accomplished with a considerably smaller volume compression of the gas energized silicone oil spring as compared to the volume compression necessary to transmit a given pressure change to a high pressure nitrogen gas spring.

Thus, the amount of silicone oil which must flow from the equalizing chamber 276 through the metering cartridge 48 to the first portion 356 of second pressure conducting passage means 304, and in the reverse direction upon the decrease of well annulus pressure, is considerably less for a tool designed for operation on compression of a gas energized silicone oil spring as compared to a tool designed for operation on compression of high pressure nitrogen gas.

Thus, in order to provide an equivalent time delay in the communication of changes in well annulus pressure to the spring chamber, it is necessary to provide a greater restriction to fluid flow through the pressurizing and depressurizing passages 296 and 298 of the metering cartridge 48. This is accomplished by providing flow restrictors 318 and 328 having a considerably smaller cross-sectional area through the jets thereof as compared to the restrictors which would be used with a tool designed to operate on compression of high pressure nitrogen gas such as that of the Beck '748 patent.

Another change which will be apparent when comparing the tool of the present invention to a device such as that shown in the Beck '748 patent, is that the present apparatus does not necessarily have a floating piston located above the metering cartridge 48, whereas a tool operating on the compression of nitrogen gas will have a floating piston located near the bottom of its spring chamber to provide a boundary between nitrogen gas in the spring chamber and liquid oil located below the spring chamber. See for example, the piston 210 in FIG. 2*e* of the Beck '748 patent.

Thus, referring to the Beck '748 patent, the floating piston 210 shown in FIG. 2*e* thereof is normally deleted when converting such a tool from nitrogen gas operation to operation on a gas energized silicone oil spring.

Experimental Data

Figure 3:
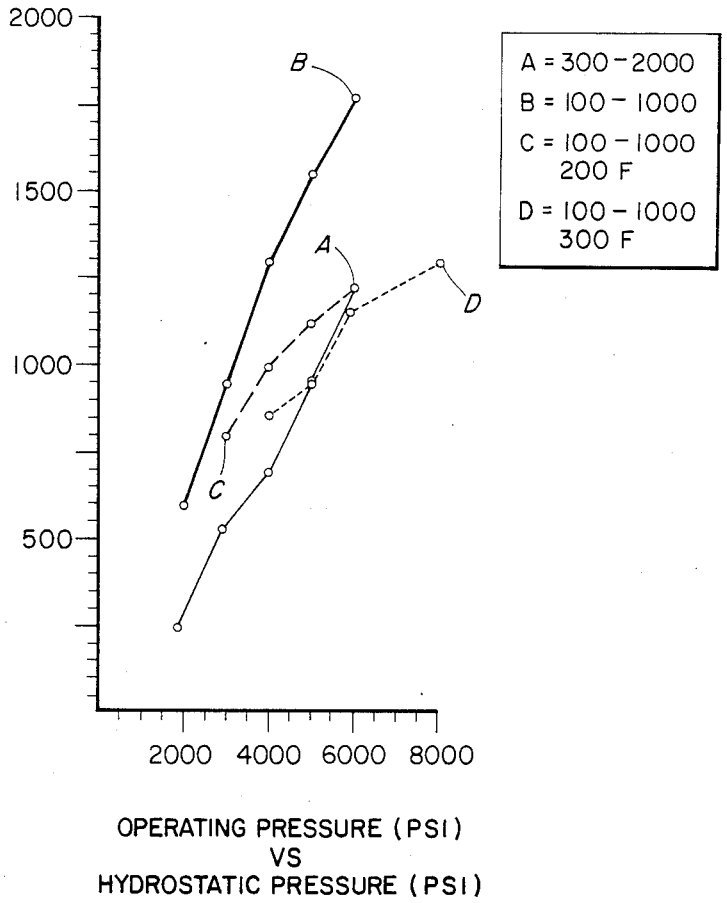
FIG. 3 is a graphical representation of test data obtained with a prototype of the present invention showing tool operating pressures as a function of hydrostatic pressure in the well annulus, for four different sets of assumptions for initial air supply pressure, initial charge pressure, and well temperature.

FIG. 3 is a graphical representation of experimental data obtained with a prototype of the present invention. FIG. 3 shows operating pressure for the apparatus 10 on its vertical axis, as a function of hydrostatic well annulus pressure shown on the horizontal axis.

The four curves A, B, C and D represent four different sets of operating parameters for the tester valve 10. These conditions are shown in shorthand notation in the box in the upper right corner of FIG. 3.

In these tests, nitrogen gas was used as the compressible gas, but it is noted that the properties of nitrogen gas, and particularly its compressibility, are substantially similar to the properties of air since air is comprised primarily of nitrogen gas.

The prototype of the tester valve 10 is utilized to obtain the data shown in FIG. 3 had a displacement of power piston 120 of 10.23 cubic inches, a volume of first portion 356 of second pressure conducting passage means 304 of 746.98 cubic inches, and a total volume of second pressure conducting passage means 304 of 1,042.75 cubic inches.

In these tests, the entire second pressure conducting passage means 304 was filled with 1,042.75 cubic inches of nitrogen gas at the specified injection pressure, and subsequently silicone oil was injected until the initial charge pressure was raised to the specified initial charge pressure.

Curve A represents the test results for a nitrogen injection pressure of 300 psi, and an initial charge pressure of 2,000 psi, at a well temperature equal to ambient temperature conditions, i.e., approximately 50° F.

Curve B represents the test results for a 100 psi nitrogen injection pressure, and a 1,000 psi initial charge pressure, at 50° F.

Curve C represents the test results for a 100 psi nitrogen injection pressure, and a 1,000 psi initial charge pressure, with a subsequent well operating temperature of 200° F.

Curve D represents the test results for a 100 psi nitrogen injection pressure, and a 1,000 psi initial charge pressure, with a subsequent well operating pressure of 300° F.

Curves B, C and D are representative of results which could be obtained in the field utilizing compressed air from a rig air system of a drilling rig at 100 psi. As previously mentioned, compressed air from a typical rig air system of a drilling rig will often be available up to approximately 140 psi.

Curve B shows that for a well having a relatively cool operating temperature of approximately 50° F., the tester valve 10 would be operative down to depths presenting a hydrostatic well annulus pressure of approximately 6,000 psi.

Curves C and D show that for wells having an operating temperature of 200° F. and 300° F., respectively, which is typical for a great many wells, the tester valve 10 will operate at substantially lower operating pressures, and as shown in curve D for an operating temperature of 300° F., the tester valve 10 will operate satisfactorily down to a depth representative of a hydrostatic well annulus pressure of approximately 8,000 psi.

It is noted that the data shown in the curves, for example in curve C, terminates at a hydrostatic well annulus pressure of approximately 6,000 psi, when the nature of the curve would indicate that the tester valve 10 would satisfactorily operate at an operating pressure of less than 2,000 psi, if the curve were extrapolated to hydrostatic pressures of substantially greater than 6,000 psi. There was another limitation present, however, in the particular prototype of the tester valve 10, namely in the available stroke of the floating piston 278 in the equalizing chamber 276.

Figure 1F:
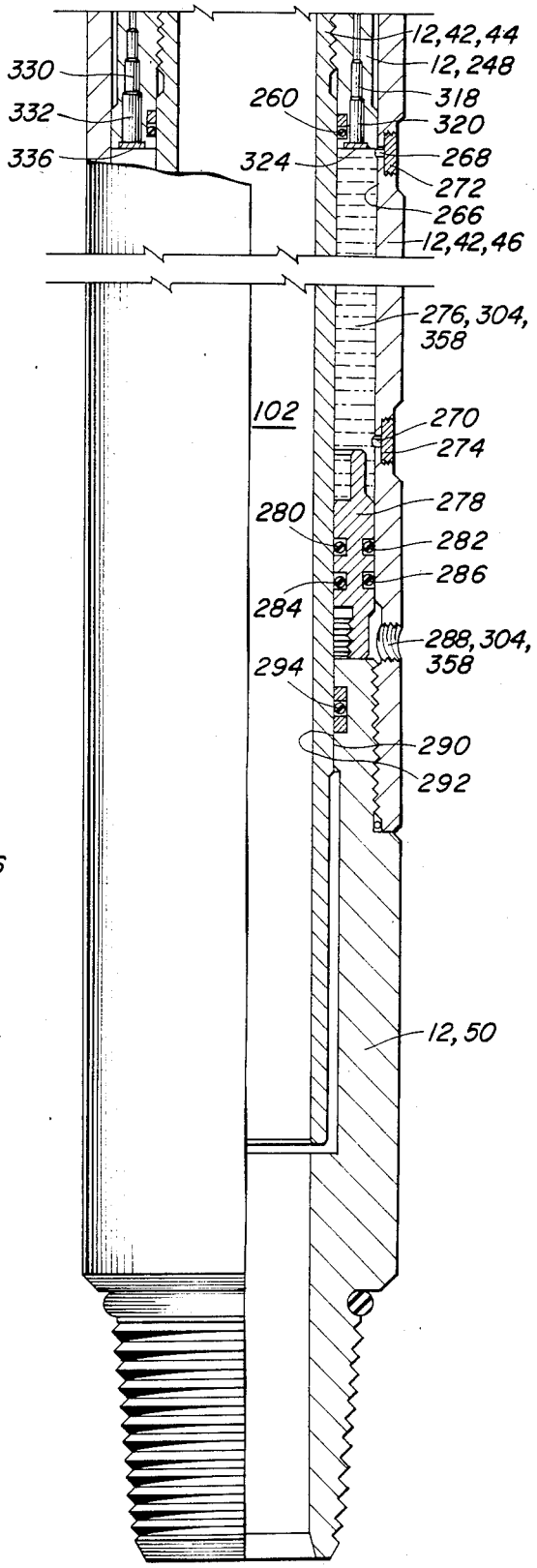

When the tester valve 10 is initially charged with compressible gas and compressible liquid, the floating piston 278 will be in its lowermost position abutting the upper end of lower adapter 50 as illustrated in FIG. 1F. As the tester valve 10 is subsequently lowered into a well, the increasing hydrostatic well annulus pressure will force the floating piston 278 upward in the equalizing chamber 276 as the gas and oil located between power piston 120 and floating piston 278 are compressed by the increasing hydrostatic well annulus pressure transferred thereto. A maximum operating depth for a particular tester valve 10 will be encountered when the floating piston 278 abuts the lower end of metering cartridge 48 so that further increases in hydrostatic well annulus pressure cannot be transferred to the compressible fluids contained thereabove.

It is helpful in understanding the test data in FIG. 3, to look at calculations of the relative volumes of gas and oil contained in the tester valve 10, and the relative changes in those volumes as the tester valve 10 is lowered into the well, and is subsequently subjected to a 2,000 psi operating pressure.

The following Table I shows the volume of air (or nitrogen) and the volume of silicone oil contained in the first portion 356 of second pressure conducting passage means 304 between power piston 120 and metering cartridge 48 for six different representative cases, each of which utilizes an initial charge pressure of 1,000 psi. These are the volumes of air and oil after the initial charge pressure of 1000 psi is applied and prior to placement of the tool in the well. As is apparent from the data in Table I, at this initial charge pressure of 1,000 psi, the compressible gas contained in the first portion 356 of second pressure conducting passage means 304 has a volume shown in the second column of Table I substantially less than a volume shown in the third column of Table I for the compressible liquid contained in the first portion 356 of second pressure conducting passage means 304.

The calculations in Tables I and II were determined utilizing compressibility factors for nitrogen gas and for silicone oil as the compressible gas and compressible liquid, respectively.

TABLE I

| Case | V-air At Initial Charge of 1000 psi ($in^3$) | V-oil At Initial Charge of 1000 psi ($in^3$) |
|---|---|---|
| #1 | | |
| 100 psi air 50° F. | 105.92 | 641.06 |
| #2 | | |
| 100 psi air 200° F. | 119.58 | 627.40 |
| #3 | | |
| 100 psi air 300° F. | 163.34 | 583.64 |
| #4 | | |
| 140 psi air 50° F. | 148.18 | 598.8 |
| #5 | | |
| 300 psi air 50° F. | 161.06 | 585.92 |
| #6 | | |
| 500 psi air 50° F. | 267.5 | 479.48 |

The volumes shown in the second and third columns of Table I for any particular case total to the volume of first portion 356 of second pressure conducting passage means 304 which as previously mentioned is 746.98 cubic inches for the particular prototype of tester valve 10 used to obtain the data in FIG. 3, and used as a model for the calculations shown in Table I.

The data in Table I for cases 1, 2 and 3 corresponds to curves B, C and D, respectively, in FIG. 3. The data for cases, 4, 5, and 6 are representative of the results which would be obtained with a higher injection pressure for the compressible gas, in a well having an operating temperature of substantially 50° F.

Additional data representative of the operation of the tester valve 10 as it is lowered into a well and subsequently subjected to a 2,000 psi operating pressure at various hydrostatic well annulus pressures is shown in the following Table II.

TABLE II

| Case | Hydrostatic Pressure (psi) | Initial V-air ($in^3$) | Initial V-oil ($in^3$) | V-air ($in^3$) | V-oil ($in^3$) | Total ($in^3$) | V-Air as % Total |
|---|---|---|---|---|---|---|---|
| #1 | | | | | | | |
| 100 psi-air | 4000 | 29.79 | 717.19 | 7.11 | 7.60 | 14.71 | 48.3% |
| 1000 psi charge | 6000 | 22.68 | 724.3 | 3.31 | 6.88 | 10.19 | 32.5% |
| 50° F. | 8000 | 19.37 | 727.61 | 1.94 | 5.97 | 7.91 | — |
| #2 | | | | | | | |
| 100 psi-air | 4000 | 40.12 | 706.86 | 10.57 | 9.33 | 19.90 | 53.1% |
| 1000 psi charge | 6000 | 29.55 | 717.43 | 5.07 | 8.25 | 13.32 | 38.1% |
| 200° F. | 8000 | 24.48 | 722.50 | 2.97 | 7.08 | 10.05 | — |
| #3 | | | | | | | |
| 100 psi-air | 4000 | 46.30 | 700.68 | 12.59 | 10.37 | 22.96 | 54.8% |
| 1000 psi charge | 6000 | 33.71 | 713.27 | 6.11 | 9.77 | 15.88 | 38.5% |
| 300° F. | 8000 | 27.60 | 719.38 | 3.06 | 8.13 | 11.73 | 26.1% |
| #4 | | | | | | | |
| 140 psi-air | 4000 | 41.68 | 705.3 | 9.95 | 7.48 | 17.43 | 57.1% |
| 1000 psi charge | 6000 | 31.73 | 715.25 | 4.64 | 6.79 | 11.43 | 40.6% |
| 50° F. | 8000 | 27.09 | 719.89 | 2.71 | 5.9 | 8.61 | — |

TABLE II-continued

| Case | Hydrostatic Pressure (psi) | Initial V-air ($in^3$) | Initial V-oil ($in^3$) | V-air ($in^3$) | V-oil ($in^3$) | Total ($in^3$) | V-Air as % Total |
|---|---|---|---|---|---|---|---|
| #5 | | | | | | | |
| 300 psi-air | 4000 | 89.07 | 657.91 | 21.25 | 6.97 | 28.22 | 75.3% |
| 1000 psi charge | 6000 | 67.82 | 679.16 | 9.91 | 6.45 | 16.36 | 60.6% |
| 50° F. | 8000 | 57.91 | 689.07 | 5.79 | 5.65 | 11.44 | 50.6% |
| #6 | | | | | | | |
| 500 psi-air | 4000 | 147.94 | 599.04 | 35.3 | 6.35 | 41.65 | 84.8% |
| 1000 psi charge | 6000 | 112.64 | 634.34 | 16.46 | 6.03 | 22.49 | 73.2% |
| 50° F. | 8000 | 96.18 | 650.8 | 9.61 | 5.34 | 14.95 | 64.3% |

The first column of Table II identifies the six cases which are the same as the six cases discussed above for Table I.

The second column of Table II sets forth three different assumed hydrostatic well annulus pressures for which calculations have been made for each of the six cases. The calculations represent the operation of the tester valve 10 for each of the six cases at hydrostatic well annulus pressures of 4000 psi, 6000 psi and 8000 psi.

The third column of Table II shows the initial volume of air in cubic inches contained in the first portion 356 of second pressure conducting passage means 304 after the tester valve 10 has been lowered to an elevation in the well corresponding to the hydrostatic well annulus pressure indicated in the second column. Similarly, the data in the fourth column of Table II shows the initial volume of oil in cubic inches contained in first portion 356 of second pressure conducting passage means 304 after the tester valve 10 has been lowered into the well. The volumes shown in the third and fourth columns of Table II for each particular situation add up to a total of 746.98 cubic inches which as previously mentioned is the volume of first portion 356 of second pressure conducting passage means 304 for the particular prototype of tester valve 10 utilized in obtaining the data in FIG. 3.

The fifth and sixth columns of Table II represent the change in volume of the air and oil, respectively, contained in the first portion 356 of second pressure conducting passage means 304, when the tester valve 10 is subjected to a relatively rapid increase in well annulus pressure of 2000 psi. The seventh column shows the total change in volume obtained by adding the fifth and sixth columns.

The eighth and last column of Table II shows the change in air volume from the fifth column as a percentage of the total change in volume from the seventh column.

As previously mentioned, the particular prototype of tester valve 10 used in the testing of FIG. 3 and used for the calculations of Table II had a lower piston 120 with a displacement of 10.23 cubic inches. Thus, any particular one of the situations shown in Table II which has a total volume change in the next to last column of significantly less than 10.23 cubic inches is representative of a situation in which the particular embodiment of tester valve 10 previously described would not operate to open its ball valve 86 at an operating pressure of 2000 psi. In those situations no data has been presented in the eighth and last column. For example, for case #1 at a hydrostatic pressure of 8000 psi, the total volume change shown in column 7 is 7.91 cubic inches which is insufficient to allow the power piston 120 to operate.

As can be appreciated by comparing the data in the third and fourth columns of Table II to the data in the second and third columns of Table I, as the tester valve 10 is lowered into a well, the volume of gas contained in first portion 356 of second pressure conducting passage means 304 decreases while the volume of oil contained therein increases. This increased volume of oil is provided by flow of oil from the equalizing chamber 276 through the pressurizing passage 296 of metering cartridge 48.

As is apparent from a comparison of the second and third columns of Table I, at the initial charge pressure the volume of gas shown in the second column is always substantially less than the volume of liquid shown in the third column. The extreme case having the highest proportion of gas is Case #6 in which the volume of gas (267.5 inches cubed) is equal to about 56% of the volume of oil seen in the third column (479.48 cubic inches). In all of the other cases, the volume of gas is substantially less than 56% of the volume of liquid.

In spite of the fact that the volume of gas is much less than the volume of liquid contained in the first portion 356 of second pressure conducting passage means 304, a substantial portion of the displacement of the power piston as it moves between its first and second positions is accommodated by a change in the air volume.

This is shown in the last column of Table II which represents the change in air volume as a percentage of the total volume change.

The least percentage change in air volume seen there is in Case #3, at a hydrostatic pressure of 8,000 psi, which shows a change in air volume of 26.1%. Generally, it can be said that at least about 25% of the displacement of the power piston is accommodated by the change in volume of the compressible gas contained in the first portion 356 of second pressure conducting passage means 304.

Thus, it is seen that the apparatus and methods of the present invention readily achieve the ends and advantages mentioned as well as those inherent therein. While certain preferred embodiments of the invention have been illustrated and described for the purposes of the present disclosure, numerous changes in the arrangement and construction of parts and steps may be made by those skilled in the art, which changes are encompassed within the scope and spirit of the present invention as defined by the appended claims.

What is claimed is:

1. An annulus pressure responsive gas energized compressible liquid spring downhole tool apparatus, comprising:

a housing;

a power piston slidably disposed in said housing;

first and second pressure conducting passage means for communicating a well annulus exterior of said housing with first and second sides, respectively, of said power piston;

retarding means, disposed in said second pressure conducting passage means, for delaying communication of a sufficient portion of a relatively rapid change in well annulus pressure to said second side of said power piston for a sufficient time to allow a pressure differential across said power piston to move said power piston between a first position and a second position relative to said housing, and for communicating relatively slow changes in well annulus pressure to said second side of said power piston sufficiently quickly that hydrostatic well annulus pressure is substantially balanced across said power piston as said apparatus is run into a well; and gas energized compressible liquid spring means, contained in a first portion of said second pressure conducting passage means between said second side of said power piston and said retarding means, for returning said power piston to its said first position in response to a relatively rapid decrease in well annulus pressure, said spring means including a first volume of pressurized compressible gas and a second volume of pressurized compressible liquid, said first and second volumes being such that a substantial portion of a displacement of said power piston as said power piston moves between its said first and second positions is accommodated by changes in each of said first and second volumes, the first volume of pressurized compressible gas being substantially greater than a volume of highly pressurized compressible gas in an annulus pressure responsive downhole tool apparatus wherein the highly pressurized compressible gas in said annulus pressure responsive downhole tool apparatus is separated by a floating piston means from the oil in said tool apparatus.

2. The apparatus of claim 1, wherein:

said retarding means is a metering cartridge dividing said second pressure conducting passage means into said first portion, which contains said liquid spring means, and a second portion between said metering cartridge and said well annulus, said second portion being characterized as an equalizing chamber, said metering cartridge having a pressurizing passage disposed therethrough communicating said first and second portions of said second pressure conducting passage means, and a fluid flow restrictor means disposed in said pressurizing passage; and said apparatus further comprises a floating piston disposed in said equalizing chamber, said equalizing chamber being filled with compressible liquid between said metering cartridge and said floating piston so that compressible liquid is metered between said first and second portions of said second pressure conducting passage means through said metering cartridge to transfer changes in well annulus pressure to said second side of said power piston.

3. The apparatus of claim 1, wherein:

said compressible liquid is silicone oil.

4. The apparatus of claim 3, wherein:

said compressible gas is compressed air supplied from a rig air system of a drilling rig.

5. The apparatus of claim 1, wherein:

said compressible gas is compressed air supplied from a rig air system of a drilling rig.

6. The apparatus of claim 1, wherein:

said gas energized compressible liquid spring means has an initial charge pressure prior to supplementation by hydrostatic well annulus pressure no greater than approximately 2000 psi; and at said initial charge pressure, said first volume of gas is very much less than said second volume of liquid.

7. The apparatus of claim 6, wherein:

at said initial charge pressure, said first volume of gas is no greater than about 56% of said second volume of liquid.

8. The apparatus of claim 6, in place within a well and subjected to hydrostatic well annulus pressure, wherein:

at said hydrostatic well annulus pressure, said first volume of gas is smaller than it was at said initial charge pressure, and said second volume of liquid is larger than it was at said initial charge pressure.

9. A method of operating a downhole tool, said method comprising the steps of:

(a) providing said tool having:

a housing;

a power piston slidably disposed in said housing;

first and second pressure conducting passage means for communicating a well annulus exterior of said housing with first and second sides, respectively, of said power piston;

retarding means, disposed in said second pressure conducting passage means, for delaying communication of a sufficient portion of a relatively rapid change in well annulus pressure to said second side of said power piston for a sufficient time to allow a pressure differential across said power piston to move said power piston between a first position and a second position relative to said housing, and for communicating relatively slow changes in well annulus pressure to said second side of said power piston sufficiently quickly that hydrostatic well annulus pressure is substantially balanced across said power piston as said apparatus is run into a well, said retarding means dividing said second pressure conducting passage means into a first portion between said second side of said power piston and said retarding means, and a second portion between said retarding means and said well annulus;

(b) filling at least said first portion of said second pressure conducting passage means with a compressible gas at an initial pressure in a range from about 100 psi to about 500 psi;

(b) after step (b), injecting a compressible liquid into said first portion of said second pressure conducting passage means and pressurizing said compressible gas and said compressible liquid to an initial charge pressure substantially in excess of 500 psi;

(d) after step (c), lowering said tool, connected to a tubing string, to a desired elevation in a well;

(e) during step (d), substantially balancing hydrostatic well annulus pressure across said power piston by means of said retarding means, and thereby raising the pressure of said gas and liquid in said first portion of said second pressure conducting passage means to be substantially equal to hydrostatic well annulus pressure at said elevation in said well;

(f) after step (e), increasing well annulus pressure relatively rapidly to create a pressure differential from said first side to said second side of said power piston and thereby moving said power piston from its said first position to its said second position relative to said housing; and (g) during step (f), accommodating a first substantial portion of a displacement of said power piston by a change in volume of said compressible gas contained in said first portion of said second pressure conducting passage means, and accommodating a second substantial portion of said displacement of said power piston by a change in volume of said compressible liquid contained in said first portion of said second pressure conducting passage means.

10. The method of claim 9, wherein:

step (b) is further characterized in that said compressible gas is compressed air supplied from a rig air system of a drilling rig at an initial pressure in a range from about 100 to about 140 psi.

11. The method of claim 10, wherein:

step (g) is further characterized in that at least about 25% of said displacement of said piston means is accommodated by said change in volume of said compressible gas contained in said first portion of said second pressure conducting passage means.

12. The method of claim 9, wherein:

step (a) is further characterized in that said retarding means is a metering cartridge dividing said second pressure conducting passage means into said first portion, which contains said liquid spring means, and a second portion between said metering cartridge and said well annulus, said second portion being characterized as an equalizing chamber, said metering cartridge having a pressurizing passage disposed therethrough communicating said first and second portions of said second pressure conducting passage means, said metering cartridge also having a fluid flow restrictor means disposed in said pressurizing passage, and said tool also including a floating piston disposed in said equalizing chamber;

step (c) is further characterized in that said compressible liquid is also injected into said equalizing chamber between said metering cartridge and said floating piston at substantially said initial charge pressure; and step (e) is further characterized in that compressible liquid flows from said equalizing chamber through said pressurizing passage to said first portion of said pressure conducting passage means to raise said pressure of the gas and liquid in said first portion of said second pressure conducting passage means.

13. The method of claim 9, wherein:

step (c) is further characterized in that said compressible liquid is silicone oil.

14. The method of claim 9, wherein:

step (c) is further characterized in that said initial charge pressure is no greater than approximately 2000 psi, and at said initial charge pressure said compressible gas contained in said first portion of said second pressure conducting passage means has a volume substantially less than a volume of said compressible liquid contained in said first portion of said second pressure conducting passage means.

15. The method of claim 14, wherein:

step (c) is further characterized in that said initial charge pressure is approximately 1000 psi.

16. The method of claim 14, wherein:

step (c) is further characterized in that at said initial charge pressure said volume of gas is no greater than about 56% of said volume of compressible liquid.

17. The method of claim 14, wherein:

a danger of explosion of said tool prior to step (d) is greatly reduced as compared to a similar tool relying substantially entirely upon compression of compressible gas to accommodate the displacement of said power piston as said power piston moves from its first position to its second position in step (f).

18. A method of substituting a gas energized compressible liquid spring for a high pressure compressible gas spring in a downhole tool, said method comprising the steps of:

(a) providing an original downhole tool constructed to operate by means of a well annulus pressure responsive power piston acting against a high pressure compressible gas disposed in a spring chamber;

(b) modifying said original tool by increasing a volume of said spring chamber; and (c) after step (b), filling said spring chamber with a first volume of compressible gas and a second volume of compressible liquid, said first and second volumes being such that a substantial portion of a displacement of said power piston is accommodated by changes in each of said first and second volumes.

19. The method of claim 18, further comprising the step of:

further modifying said original tool by decreasing an area of said power piston thereby decreasing said displacement thereof and lowering a required volume of said spring chamber, as compared to a volume of said spring chamber that would otherwise be required in the absence of said step of decreasing said area of said power piston.

20. The method of claim 18, wherein:

said step (a) is further characterized in that said original tool includes a liquid-filled equalizing chamber communicated with said well annulus, and includes an original metering cartridge disposed between said spring chamber and said equalizing chamber, said metering cartridge having a restricted passageway through which liquid must pass to transmit a change in well annulus pressure between said equalizing chamber and said spring chamber; and said method includes a step of further modifying said original tool by providing a modified metering cartridge having a smaller cross-section restricted passageway than said original metering cartridge, to thereby provide a reduced liquid flow rate therethrough during a given time delay period for a given pressure differential between said spring chamber and said equalizing chamber.

* * * * *

UNITED STATES PATENT AND TRADEMARK OFFICE

CERTIFICATE OF CORRECTION

PATENT NO. : 4,665,991

DATED : May 19, 1987

INVENTOR(S) : Kevin R. Manke

It is certified that error appears in the above-identified patent and that said Letters Patent is hereby corrected as shown below:

In Column 20, line 51, Delete [(b)] and insert therefor -- (c)--.

Signed and Sealed this

Fifteenth Day of September, 1987

*Attest:*

DONALD J. QUIGG

*Attesting Officer*

*Commissioner of Patents and Trademarks*